US005282339A

United States Patent [19]

Devlin et al.

[11] Patent Number: 5,282,339

[45] Date of Patent: Feb. 1, 1994

[54] AIRCRAFT SERVICING PIT WITH RETRACTABLE LADDER

[75] Inventors: Michael Devlin, Anaheim; Eynon Johnson, Orange, both of Calif.

[73] Assignee: Dabico Inc., Costa Mesa, Calif.

[21] Appl. No.: 873,766

[22] Filed: Apr. 27, 1992

[51] Int. Cl.[5] ..... E06C 7/18; E02D 29/12

[52] U.S. Cl. ..... 52/20; 52/183; 52/184; 52/186; 182/93; 182/106

[58] Field of Search ..... 182/206, 93, 106; 52/19, 20, 21, 183, 184, 186, 169.6

[56] References Cited

U.S. PATENT DOCUMENTS 3,786,899 1/1974 Zenhauserr ..... 182/93

4,907,674 3/1990 Miller ..... 182/206

*Primary Examiner*—Carl D. Friedman

*Assistant Examiner*—Robert Canfield

*Attorney, Agent, or Firm*—Charles H. Thomas

[57] ABSTRACT

An aircraft servicing pit located beneath a surface across which aircraft travel while on the ground is provided with a ladder and a pair of reciprocally retractable handrails on each side of the ladder. Each of the handrails has an inverted "J-shaped" configuration. With the lid open the handrails can be drawn up out of the pit and rotated so that their legs can rest upon the tarmac surface at the edge of the pit. Service personnel utilizing the pit are thereby provided with stabilizing hand grips which enhance their safety when entering and leaving the subsurface chamber within the pit. When the pit is to be closed the retractable handrails are lifted, rotated, and lowered to their fully retracted storage positions.

14 Claims, 2 Drawing Sheets

AIRCRAFT SERVICING PIT WITH RETRACTABLE LADDER

BACKGROUND OF THE INVENTION

1. Field of the Invention

The present invention relates to an improved access arrangement for pits designed for use in servicing aircraft at docking, loading and refueling terminals.

2. Description of the Prior Art

At modern aircraft terminals servicing of aircraft on the ground is frequently performed using prefabricated pits which are installed at aircraft docking, fueling and loading areas beneath the surface of the tarmac across which aircraft travel during docking and departure maneuvers. The pits are typically formed of fiberglass, steel or aluminum and are constructed as enclosures with surrounding walls, and an access lid at the top of the walls. The pits are installed below the surface of loading and refueling aprons at aircraft terminals, remote parking locations and maintenance bases.

The purpose of the pits is to allow ground support functions to be carried out from subsurface enclosures. These ground support functions include the provision of fuel, the provision of electricity to the aircraft while it is in the docking area, the provision of air for cooling the aircraft interior, the provision of pressurized air for starting the aircraft engines, and for other aircraft support activities on the ground. The use of subsurface pits eliminates the need for mobile trucks, carts and other vehicles which are otherwise present in the loading area and which interfere with the arrival and departure of aircraft in the vicinity of a loading gate. The use of subsurface pits also allows the provision of fuel, power, cooling and pressurized air, and other supplies from a central location. The necessary fluid supplies and electrical power can be generated or stored with great efficiency at a central location, as contrasted with mobile generating or supply vehicles.

The pits located below the aircraft terminal area house valves, junction boxes, cooling air terminations and other terminal equipment that is temporarily connected to an aircraft that has been docked. Umbilical pipes and lines, otherwise housed within the pits, are withdrawn from the pits through hatches therein and are coupled to a docked aircraft to supply it with fuel, air for cooling the aircraft interior, pressurized air for starting the engines, and electrical power.

The pits are constructed with hinged lids that are movable between open positions allowing access to the pits and closed positions which are flush with the surface of the docking, loading or refueling area across which aircraft travel and beneath which the pits are mounted. Because the pits are located beneath the surface upon which the aircraft travel while on the ground, aircraft servicing personnel must descend into the pit in order operate valves, withdraw aircraft refueling lines, electrical power lines, air conditioning ducts, and to otherwise utilize the pit for its intended purpose.

To enable aircraft servicing personnel to descend into an aircraft pit, an upright ladder is typically mounted on one of the pit walls. The ladder has a pair of upright side rails which are normally held in a vertical disposition out a few inches from the surface of the wall. Transverse, horizontal ladder rungs or steps extend between the side rails of the ladder. The space between the ladder rung and the wall upon which the ladder is mounted enables a person to achieve a foothold on the ladder rungs as the individual descends the ladder.

One significant difficulty which currently exists with subsurface aircraft servicing pits is that because the lid of the pit must shut flush with the paved surface across which the aircraft move while on the ground, it is not possible to provide hand holds or grips protruding above grade to assist aircraft servicing personnel in beginning a decent into the pit, or to assist such personnel in emerging from the pit. As a result, personnel who must gain access to the pit are forced to get down on their hands and knees in order to begin the descent. Even so, the initial steps down into the pit are still quite difficult to make, as the descending service personnel cannot gain a secure hand grip on the ladder while taking the first few steps from the top of the ladder down. The present practice of descending the ladder of a subsurface aircraft servicing pit is therefore somewhat unsafe. If a worker's foot slips on a ladder rung either at the beginning of the descent or in emerging from the pit, the worker can easily fall down into the pit. There has heretofore been no steady and accessible hand grip which can be utilized to prevent such a fall.

SUMMARY OF THE INVENTION

A primary object of the present invention is to provide aircraft service personnel with secure hand grips in beginning a descent into a subsurface chamber defined below a surface across which aircraft travel, and in completing and ascent therefrom. According to the invention secure handholds are provided which are conveniently available to aircraft servicing personnel above the grade of the surface beneath which the pit is installed. However, the handrails provided do not interfere with the movement of aircraft across the surface, since they are fully retractable into the aircraft servicing pit prior to closing the pit lid.

The present invention provides aircraft servicing personnel with an increased measure of occupational safety in climbing into and out of subsurface aircraft servicing pits. The retractable handrails can be pulled up and out of the pit and stabilized to provide secure hand grips before a worker even sets foot on the first rung of the access ladder in the pit. Also, the handgrips remain stable and provide assistance to a worker even after the worker has completely ascended the ladder and has fully emerged from the pit.

In one broad aspect the present invention may be considered to be an improvement in a subsurface chamber defined below a surface across which aircraft travel and having an access lid movable to a closed position flush with the surface and capable of withstanding the weight of the tires of an aircraft traveling thereacross and in which a ladder is located beneath the surface. The improvement of the invention is comprised of a pair of retractable handrail assemblies each having an upright supporting leg, an upright linear guide rail longer than the supporting leg, and a transverse connecting structure joining the leg to the guide rail. The improvement also includes some means for mounting the guide rails for linear, reciprocal movement relative to the ladder in the pit. In this way the handrail assemblies are movable between fully retracted positions below the surface and extended positions in which the connecting structures project above the surface and the supporting legs of the handrail assemblies rest upon the surface.

In preferred embodiments of the invention some means is provided for preventing the guide rails from rotating relative to the ladder when the handrail assemblies are in their extended positions. In this connection the means for mounting the handrails to the ladder is preferably comprised of a pair of upright sleeves located alongside the ladder. The linear guide rails fit telescopically into the sleeves and are moveable in reciprocal fashion therewithin. By providing the guide rails and the sleeves with a system of longitudinal tracks and track followers which are engaged when the handrails are in their extended positions, the handrails cannot twist in the hands of the servicing personnel as they grip them. Thus, the handholds provided are safe and secure when utilized for entering and leaving the pit, although the handrails can be easily retracted into the pit for storage.

In a preferred embodiment of the invention the guide rails are of a cylindrical cross section and are each provided with a transversely projecting appendage or protrusion which serves as a key, or track follower. Each sleeve within which the guide rails reciprocally move is anchored either to the ladder or to the wall of the pit. At least a pair of longitudinally extending tracks are defined within each of the sleeves on each side of the ladder. These tracks are adapted to alternatively receive the appendages or track followers of the guide rails therewithin.

The tracks both have upper extremities that terminate a spaced distance beneath the upper extremities of the sleeve. As a consequence, when the guide rails are pulled as far out of the pit as they can be, the track followers reside at a level above the upper extremities of the tracks. This allows the guide rails to be twisted in rotation in the space above the tracks, typically through arcs of about ninety degrees, while the lower extremities of the legs of the retractable handrail assemblies are at a level about three inches above the grade of the surface across which the aircraft travel.

Once the handrail assemblies have been rotated sufficiently so that the handrail legs are located above the surface in which the pit is mounted, rather than above the pit opening, the handrail assemblies are lowered slightly. The keys or track followers thereupon enter into the other tracks which are provided and which also prevent the guide rails from rotating relative to the ladder when the track followers are engaged therewith. The downward force exerted by the hands of the service personnel on the handrails as they enter and leave the pit aid the force of gravity in holding the track followers engaged in the tracks while the feet of the handrail legs rest on the surface of the aircraft service area.

Naturally, the lid cannot be closed during the time that the handrail assemblies are erected and project upwardly from the pit and out onto the surface of the apron. The protrusion of the handrail assemblies from the pit prevents the pit lid from closing with service personnel in the pit. Also, the upward projection of the handrail assemblies provides a clear, visible indication that service personnel are in the pit or that the pit is open. The handrail assemblies thereby enhance the safety of use of the pit in several different ways.

Some means is preferably provided for preventing the complete withdrawal of the guide rails from the sleeves. That is, while the guide rails can be lifted almost free of the sleeves in which they are telescopically engaged, the lower extremities of the guide rails are entrapped within the sleeves. This feature prevents the handrails from being completely drawn out of the pit and ensures that the handrail assemblies do not become misplaced.

Also, some means is preferably provided for preventing the guide rails from rotating relative to the ladder in the pit when the handrails are in their fully retracted positions. To this end the tracks and track followers of the guide rails and the sleeves in which the guide rails telescopically move are constructed in such a manner that as the handrail assemblies are lowered into their retracted positions, the legs of the handrail assemblies are lowered into the space between the rungs of the ladder and the wall upon which the ladder is mounted. The legs of the handrail assemblies are thereby entrapped between the wall of the pit upon which the ladder is mounted and at least the uppermost rung of the ladder. This provides a constraint which prevents the guide rails from rotating relative to the ladder once the handrails have been lowered into their retracted positions.

Some means is also preferably provided for limiting the extent of rotation of the guide rails relative to the sleeves, so that the guide rails can only be rotated between their alternative positions of engagement with the tracks in the sleeves when and only when the handrail assemblies have been pulled up out of the pit to their maximum limit of extension. This means for limiting rotation may be achieved by providing rotational stops at the upper extremities of the sleeves. The guide rails can thereby be rotated only through arcs of about ninety degrees relative to the sleeves in which they are telescopically mounted and only at the upper limit of reciprocal, longitudinal movement relative thereto.

The invention may be described with greater clarity and particularity by reference to the accompanying drawings.

DESCRIPTION OF THE EMBODIMENT

Figure 1:
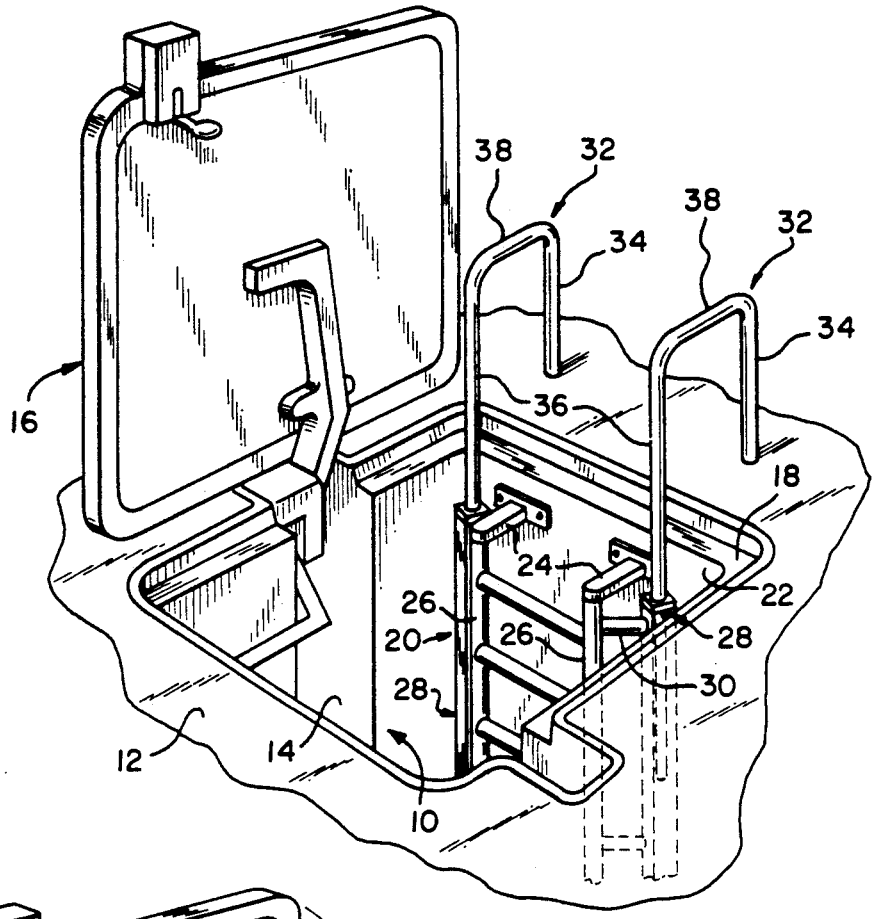
FIG. 1 is a perspective view showing a subsurface chamber according to the invention with the handrail assemblies of the invention in their extended positions withdrawn therefrom.
Figure 2:
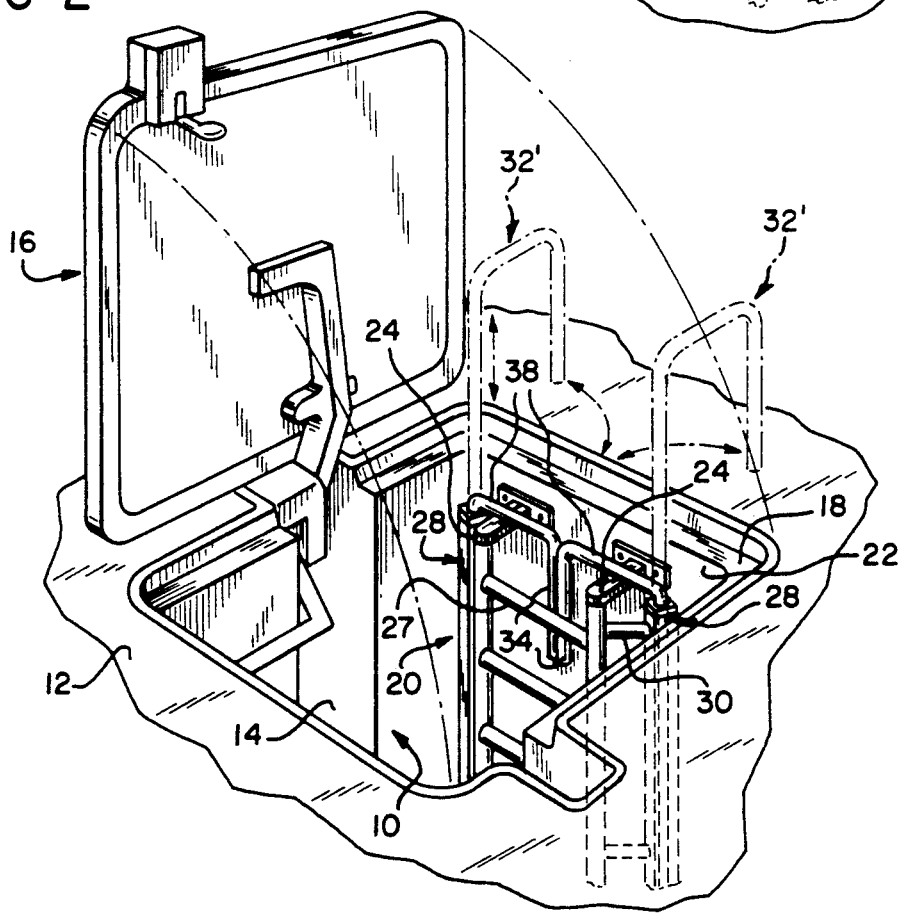
FIG. 2 is a perspective view showing how the handrails depicted in FIG. 1 are moved to their fully retracted positions.

FIGS. 1 and 2 illustrate a prefabricated pit 10 of the type designed for installation below a tarmac surface 12 at an aircraft docking area. The pit 10 is formed of fiberglass and defines a subsurface chamber 14 located below the level of the surface 12 across which aircraft travel. The prefabricated pit 10 has a heavy metal lid 16 which is hinged to the body of the pit 10 that defines the subsurface chamber 14 along one edge thereof. The lid 16 is movable relative to the chamber 14 between an open position, as depicted in both FIGS. 1 and 2, and a closed position in which it is seated within a lid frame 18, as indicated in FIG. 2. In the closed position the exposed top of the lid 16 is flush with the tarmac surface 12.

The pit 10 contains an upright ladder 20 therewithin. The ladder 20 is fastened in a vertical disposition onto one of the four upright walls 22 of the pit 10 that bound the subsurface chamber 14. The ladder 20 is held by means of brackets 24 out away from the wall 22 a distance of several inches.

The ladder 20 is constructed with a pair of upright, vertically disposed side rails 26, and a plurality of rungs 27 that are horizontally disposed at vertically spaced intervals between the side rails 26.

Alongside the ladder side rails 26 and parallel thereto are a pair of vertical, upright guide sleeves 28 that are rigidly secured to the side rails 26 by means of spacing bars 30. Both the ladder 20 and the guide sleeves 28 terminate beneath the lid 16 and within the subsurface chamber 14, even when the lid 16 is in its closed position.

According to the improvement of the invention, a pair of handrail assemblies 32 are provided on opposite sides of the ladder 20. Each of the handrail assemblies 32 is shaped in the form of an inverted "J" or an upwardly convex crook, as best illustrated in FIG. 1. Each handrail 32 has a supporting leg 34 at one end thereof and a guide rail 36 at the opposite end thereof. The guide rails 36 are several feet longer than the legs 34 of the handrails 32 and are connected and held parallel thereto by transverse horizontally disposed connecting bars 38.

The guide sleeves 28 that are disposed on the opposite sides of the ladder 20 serve as a means for mounting the guide rails 36 for linear, reciprocal movement relative to the ladder 20. The guide sleeves 28 laterally constrain the guide rails 36 in their reciprocal movement relative to the ladder 20 between lowered positions, as illustrated in solid lines in FIG. 2, and raised positions, as illustrated in FIG. 1. When the crooks of the handrails 32 are moved to their retracted positions, as illustrated in FIG. 2, the entire handrail assemblies 32 are located completely within the subsurface chamber 14 and are fully withdrawn into the pit 10 beneath the level of the tarmac surface 12.

On the other hand, when the handrail assemblies 32 are pulled upwardly and moved to their extended positions as illustrated in FIG. 1, the crooks of the handrails 32 project above the grade of the surface 12. With the handrails 32 in their extended positions as depicted in FIG. 1, the lower extremities of the legs 34 rest upon the tarmac surface 12. As illustrated in FIG. 1, the handrails 32 project upwardly from the surface 12 a distance of at least one foot, so as to provide hand grips for aircraft service personnel who wish to climb down into the pit 10.

Figure 3:
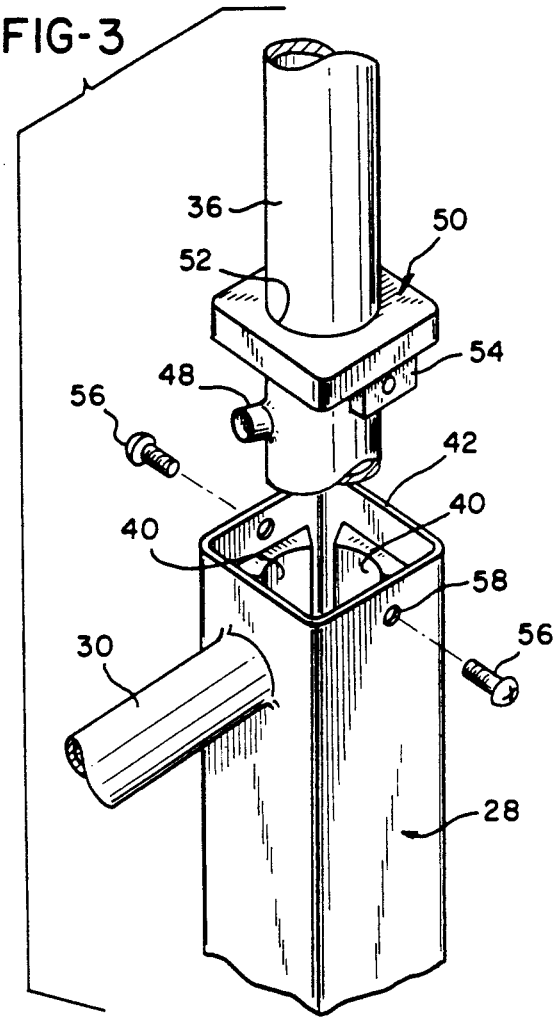
FIG. 3 is a perspective partially exploded view showing the interconnection of the handrail assemblies to the mounting structure in the pit in the embodiment of FIGS. 1 and 2.
Figure 4:
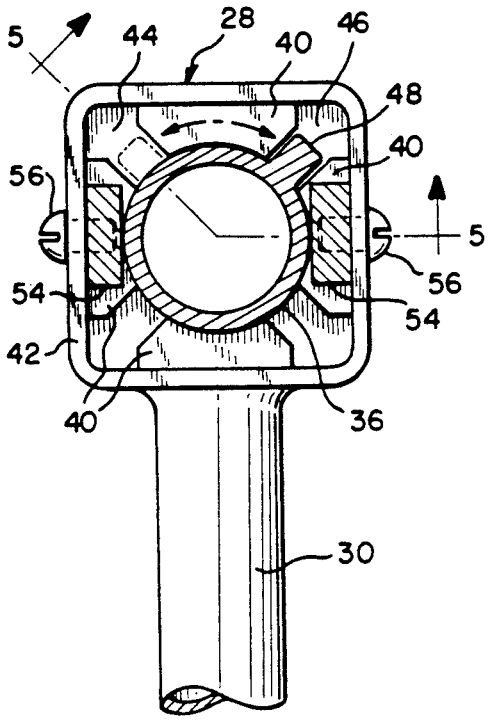
FIG. 4 is a top plan sectional view of the structure depicted in FIG. 3.
Figure 5:
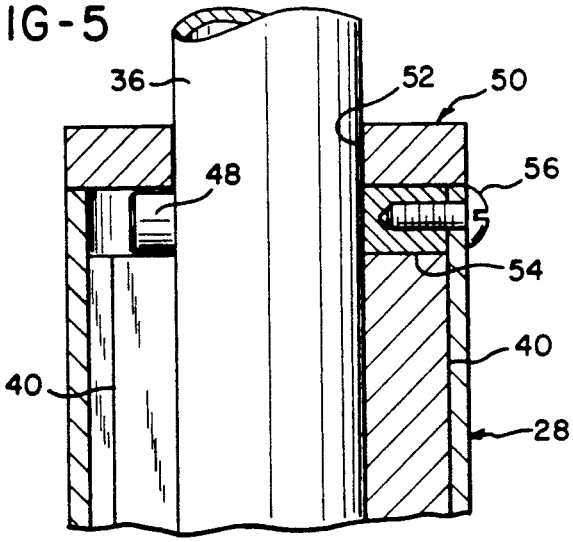
FIG. 5 is an elevational sectional view taken along the lines 5—5 of FIG. 4.

As illustrated in FIGS. 3, 4 and 5, the guide sleeves 28 are formed of hollow, tubular steel stock having a substantially square cross section. The handrails 32 are formed of tubular steel stock bent into the generally "J-shaped" configuration illustrated, with the guide rails 36 extending telescopically down into the guide sleeves 28. The guide rails 36 are thereby vertically moveable in reciprocal fashion within the guide sleeves 28.

Within the guide sleeves 28 there are four elongated extruded plastic guides 40 which have inwardly facing, exposed, arcuate surfaces and outwardly facing flat surfaces. The flat surfaces of the extruded plastic guides 40 are secured flush against the flat interior walls of the tubular guide sleeves 28. The extruded plastic guides 40 terminate about five eighths of an inch below the upper edges 42 of the guide sleeves 28. The extruded plastic guides 40 extend downwardly a distance of about three feet, within the guide sleeves 28 which is longer than the lengths of the guide rails 36.

As best illustrated in FIG. 4, the extruded plastic guides 40, together with the structures of the guide sleeves 28, form vertical, parallel, radially directed tracks at each of the corners of the guide sleeves 28. A first of these longitudinal tracks is indicated at 44 and a second longitudinal track is indicated at 46 in FIG. 4. The tracks 44 and 46 extend vertically and are parallel to each other.

Each of the guide rails 36 is provided with a radially projecting appendage or protrusion 48 near its lower extremity. The protrusions 48 are welded to and extend radially outwardly from the outer cylindrical surfaces of the guide rails 36. The protrusions 48 serve as track followers and are selectively and alternatively engagable in the first tracks 44 and in the second tracks 46.

When the handrails 32 are in their lower, retracted positions as illustrated in solid lines in FIG. 2, the track followers 48 are engaged in the first tracks 44. In these positions the transverse connecting bars 38 of the handrail assemblies 32 are directed inwardly toward each other, as illustrated in solid lines, with the legs 34 of the handrail assemblies 32 extending down between the wall 22 and the top rung 27 of the ladder 20. The top ladder rung 27 and the surface of the wall 22 thereby serve as one means for constraining the guide rails 36 from rotating relative to the ladder 20 when the handrails 32 are in the fully retracted position depicted in solid lines in FIG. 2. This is because the guide rails 32 can only rotate slightly to the extent permitted by the space between the top ladder rung 27 and the wall 22.

To move the handrail assemblies 32 to the extended positions, an individual standing at the edge of the pit 10 merely pulls upwardly on the handrail assemblies 32 by means of the transverse connecting bars 38. The track followers 48 projecting outwardly into the first tracks 44 of the guide sleeves 28 constrain the guide rails 36 from rotating as the handrail assemblies 32 are drawn vertically upwardly out of the pit 10. The transverse connecting bars 38 thereby remain directed toward each other in the dispositions indicated in solid lines in FIG. 2 until the protrusions 48 clear the tops of the extruded plastic guides 40 and the handrails 32 are in te fully withdrawn positions indicated in phantom at 32' in FIG. 2.

Once the protrusions 48 are no longer constrained to move within the first tracks 44, the guide rails 36 can be moved in rotation, as illustrated in FIG. 4. The protrusions 48 are able to move in the space above the tops of the plastic extrusions 40. The handrail assemblies 32 are thereupon rotated ninety degrees, each handrail assembly 32 being rotated in an opposite direction relative to the other. At his time the lower extremities of the legs 34 are at a level several inches above the tarmac surface 12. Once the guide rails 36 have been rotated through an arc of about ninety degrees, the protrusions 48 are in registration with the second tracks 46.

The handrail assemblies 32 can thereupon be lowered slightly. With the transverse connecting bars 38 extending out over the surface 12, the handrail assemblies 32 can only descend a few inches until the lower extremities of the legs 34 come to rest upon the tarmac surface 12. However, this distance is sufficient to engage the protrusions 48 in the second tracks 46, which thereupon constrain the guide rails 36 from rotating relative to the ladder 20 when the hand rail assemblies 32 are in the extended positions with the legs 34 resting atop the surface 12, as depicted in solid lines in FIG. 1. The track followers formed by the protrusions 48 and the second tracks 46 thereby serve as a means for preventing rotational movement of the guide rails 36 relative to the ladder 20. They are operative to perform this function when the guide rails 36 are in the extended positions shown in FIG. 1.

As best illustrated in FIGS. 3 and 5, each of the guide sleeves 28 is provided with an annular collar 50 at its upper edge 42. Each collar 50 has a central, circular opening 52 therein and has a generally square outer perimeter. The collars 50 rest atop the upper edges 42 of the guide sleeves 22. The circular openings 52 are such as to receive and permit free longitudinal passage of the guide rails 36 therethrough. Each of the collars 50 has a pair of downwardly projecting tabs or stops 54 welded or otherwise secured to its underside. The stops 54 on each collar 50 are diametrically opposed from each other and depend from the underside of each of the collars 50.

Each of the tabs or stops 54 is transversely tapped to receive the threaded shank of a machine screw 56. The screws 56 are inserted through aligned openings 58 in opposing walls of the guide sleeves 28, as best illustrated in FIGS. 3 and 4. With the screws 56 engaged in the tapped openings in the stops 54, the collars 50 are secured atop the guide sleeves 28. The collars 50 thereby prevent complete withdrawal of the guide rails 36 from the guide sleeves 28, since the appendages or protrusions 48 will not pass through the circular openings 52 in the collars 50, but will instead abut against the undersides of the collars 50.

The tabs or stops 54 on the collars 50 also serve as internal rotational stops to limit the extent of rotation of the guide rails 36 relative to the guide sleeves 28. As best illustrated in FIG. 4, the guide rails 36 can be rotated through an arc of about ninety degrees. The projections 48 are limited in rotation by the diametrically opposed stops 54 on the undersides of the collars 50.

In the use of the improved pit 10 the lid 16 is first opened from a closed position, as illustrated in FIG. 2. When the lid is in the closed position the handrail assemblies 32 are fully retracted within the guide sleeves 28, as illustrated in solid lines in FIG. 2. In this position the protuberances 48 reside in registration in the first tracks 44 within their respective guide sleeves 28. The guide rails 36 are restricted in rotation by the engagement of the protuberances 48 in the tracks 44, as well as by the fact that the legs 34 are entrapped in between the upper ladder rung 27 and the surface of the wall 22.

To bring the handrail assemblies 32 into their operational positions a user pulls upwardly on the transverse connecting bars 38, thereby drawing the guide rails 36 up out of the respective guide sleeves 28 in which they are stored. The guide rails 36 are constrained from rotating until the protuberances 48 clear the tops of the extruded plastic guides 40 within the guide sleeves 28. This occurs when the protuberances 48 reach a position of abutment against the undersides of the collars 50. The guide rails 36 can thereupon be rotated to the positions depicted in phantom at 32' as shown in FIG. 2. When this occurs the protuberances 48 each pass across the top of one of the plastic guides 40 from registration with the first track 44 to registration with the second track 46, as illustrated in FIG. 4.

When the guide rails 36 have been pulled to the limit allowed by the interference between the protuberances 48 and the undersides of the collars 50, the lower extremities of the feet 34 reside a few inches above the tarmac surface 12. Once the guide rails 36 have been rotated so that the connecting bars 38 extend outwardly from the guide rails 36 out over the edge of the pit 10 and out over the tarmac surface 12, as depicted in phantom at 32' in FIG. 2, the handrail assemblies 32 can be lowered slightly. Due to the rotational constraints provided by the stops 52, the protuberances 48 will at this time be in registration with the second tracks 46 between adjacent plastic guides 40. The hand rail assemblies 32 are then lowered the few inches possible until the lower extremities of the legs 34 bear downwardly against the tarmac surface 12, as illustrated in FIG. 1.

The handrail assemblies 32 are thereupon in their extended positions. Aircraft servicing personnel, seeking to enter the pit, can grip the transverse connecting bars 38, one in each hand, to steady themselves as they begin their descent into the subsurface chamber 14, stepping on the ladder rungs 27.

When the lid of the pit 16 is to be closed, the procedure is reversed. That is, the handrail assemblies 32 are lifted up the few inches allowed from the extended positions of FIG. 1 to the slightly elevated positions depicted in phantom at 32' in FIG. 2. The handrail assemblies are then counter-rotated so that the transverse connecting bars 38 are directed toward each other and the legs 34 are brought within the perimeter of the opening of the pit 10. The handrail assemblies 32 are thereupon lowered downwardly with the protuberances 48 serving as track followers in the tracks 44. When the handrail assemblies 32 are in their fully retracted positions the transverse connecting bars 38 are below the level of the underside of the lid 16 and within the subsurface chamber 14 of the pit 10. The lid 16 can thereupon be closed.

Undoubtedly, numerous variations and modifications of the invention will become readily apparent to those familiar with subsurface chambers for servicing aircraft. Accordingly, the scope of the invention should not be construed as limited to this specific embodiment depicted and described, but rather as defined in the claims appended hereto.

We claim:

1. In a subsurface chamber defined below a surface across which aircraft travel and having a ladder located beneath said surface and an access lid movable to a closed position flush with said surface and capable of withstanding the weight of an aircraft traveling thereacross, the improvement comprising a pair of retractable handrail assemblies each having an upright supporting leg, an upright linear guide rail longer than said supporting leg, and a transverse connecting structure joining said support leg to said guide rail, and means for mounting said guide rails for linear, reciprocal movement relative to said ladder, whereby said handrail assemblies are movable between fully retracted positions below said surface and extended positions in which said connecting structures project above said surface and said supporting legs rest upon said surface.

2. A subsurface chamber according to claim 1 further comprising means for preventing said guide rails from rotating relative to said ladder when said handrail assemblies are in said extended positions.

3. A subsurface chamber according to claim 1 further comprising means for constraining said guide rails from rotating relative to said ladder when said handrails are in said fully retracted positions.

4. A subsurface chamber according to claim 1 wherein said means for mounting is comprised of a pair of upright sleeves located alongside said ladder, whereby said linear guide rails fit telescopically into said sleeves and are movable in reciprocal fashion therewithin.

5. A subsurface chamber according to claim 4 wherein said guide rails are of cylindrical cross section and are each provided with a transversely projecting appendage, and each sleeve has at least a pair of longitudinally extending tracks defined therewithin adapted to alternatively receive said appendage therein, and said tracks both have upper extremities that terminate a spaced distance beneath the upper extremities of said sleeve, and further comprising collars atop said sleeves with central circular openings therein adapted to receive and permit passage of said guide rails therethrough, whereby said appendages are laterally constrained to move along a first track in each sleeve as said handrail assemblies are moved from said fully retracted positions to above and beyond said extended positions, and said guide rails are rotatable within said sleeves once said appendages are clear of said upper extremities of said tracks to thereby allow said appendages to be shifted into registration with a second of said tracks for movement of said handrail assemblies into said extended positions.

6. A subsurface chamber according to claim 5 further comprising internal rotational stops on said collars to limit the extent of rotation of said guide rails relative to said sleeves.

7. In a subsurface chamber for use in servicing aircraft that travel across a surface and having a lid movable relative to said chamber between an open position and a closed position flush with said surface, said pit containing an upright ladder therewithin that terminates beneath said lid, the improvement comprising a pair of handrails on opposite sides of said ladder each shaped in the form of an inverted "J" with a leg and a guide rail longer than said leg, means for laterally constraining said guide rails in reciprocal movement between lowered positions beneath said surface and raised positions in which they extend above said surface, whereby said handrails are movable between retracted positions located completely within said chamber and extended positions in which said handrails project above said surface with said legs resting thereon.

8. A subsurface chamber according to claim 7 in which said means for laterally constraining said guide rails is comprised of a pair of tubular sleeves on opposite sides of said ladder which receive said guide rails in telescopically reciprocal fashion.

9. A subsurface chamber according to claim 8 wherein said sleeves are each provided with first and second longitudinal, parallel tracks which terminate a spaced distance from upper extremities of said sleeves, and said guide rails are both equipped with track followers, and said track followers of said guide rails are engaged in said first tracks as they are moved from said lowered positions toward said raised positions and with said second tracks when said guide rails are in said raised positions, whereby said second tracks and said track followers prevent rotation of said guide rails relative to said sleeves when said handrails are in said extended positions.

10. A subsurface chamber according to claim 9 further comprising means for preventing complete withdrawal of said guide rails from said sleeves.

11. A subsurface chamber according to claim 10 further comprising an annular collar at the upper extremity of each of said sleeves, whereby said track followers on said guide rails abut against said collars when said guide rails are fully extended from said sleeves, whereby said collars and said track followers serve as said means for preventing complete withdrawal of said guide rails from said sleeves.

12. A subsurface chamber according to claim 11 further comprising rotational stops within said upper extremities of said sleeves to restrict rotation of said guide rails within said sleeves.

13. In an aircraft servicing pit located beneath a surface across which aircraft travel, said pit being formed with walls, a lid movable between an open position and a closed position flush with said surface, and a ladder mounted within said pit beneath said surface, the improvement comprising a pair of reciprocally retractable handrails on each side of said ladder each being formed with an upwardly convex crook having a leg at one end and a guide rail longer than said leg at an opposite end, means for securing said handrails to said ladder in a manner permitting reciprocal movement of said handrails relative to said ladder and for laterally constraining said guide rails during reciprocal movement of said handrails relative to said ladder between retracted positions in which said crooks are fully withdrawn into said pit beneath the level of said surface and extended positions in which said crooks project above said surface and said legs rest thereon.

14. An aircraft servicing pit according to claim 13 further comprising means for preventing rotational movement of said guide rails relative to said ladder that is operative when said handrails are in said extended positions.

* * * * *